United States Patent [19]

Green

[11] Patent Number: 4,533,818

[45] Date of Patent: Aug. 6, 1985

[54] ELECTRIC HAIR CURLER WITH SELF-CONTAINED BATTERY POWER SUPPLY

[76] Inventor: Sara Green, 340 S. Kenmore, #205, Los Angeles, Calif. 90020

[21] Appl. No.: 466,842

[22] Filed: Feb. 16, 1983

[51] Int. Cl.[3] ..... A45D 2/36; H05B 3/02

[52] U.S. Cl. ..... 219/222; 132/9; 132/11 R; 132/33 R; 132/40; 219/230; 219/240; 219/242; 219/541

[58] Field of Search ..... 219/222–226, 219/243, 244, 230, 240, 541, 242; 132/7, 9, 219/11 R, 11 A, 31 R, 31 A, 32 R, 32 A, 33 R, 219/33 A, 33 B, 37 R, 37 A, 39, 40

[56] References Cited

U.S. PATENT DOCUMENTS

| | | | |
|---|---|---|---|
| 3,291,142 | 12/1966 | Green et al. | 132/40 |
| 3,398,474 | 8/1968 | Weitzner | 219/244 X |
| 3,603,765 | 9/1971 | Underwood | 219/242 X |
| 4,212,311 | 7/1980 | del Valle | 132/31 A |
| 4,227,541 | 10/1980 | Satchell | 219/225 X |
| 4,354,092 | 10/1982 | Manabe et al. | 219/240 X |

FOREIGN PATENT DOCUMENTS

| | | | |
|---|---|---|---|
| 1401882 | 4/1965 | France | 219/240 |
| 1553082 | 12/1968 | France | 219/240 |
| 1326121 | 8/1973 | United Kingdom | 219/225 |
| 1440825 | 6/1976 | United Kingdom | 132/33 R |
| 2021943 | 12/1979 | United Kingdom | 219/222 |

*Primary Examiner*—A. Bartis

*Attorney, Agent, or Firm*—Beehler, Pavitt, Siegemund, Jagger & Martella

[57] ABSTRACT

An electrically heated hair roller includes a roller body defining an exterior curling surface and a hair clamp pivotally mounted to the roller body and movable toward and away therefrom between in open position allowing hair to be wound on the body and a closed position clamping wound hair against the curling surface. An electric heater within the roller body heats the curling surface and is powered by a battery contained within a compartment formed in the clamp. Cooperative separable electrical plug and jack elements on the clamp and roller body electrically interconnect the battery to the electric heater. The connector elements also operate as a mechanical fastener for securing the clamp in the closed position. The arrangement is such that the electrical interconnection is interrupted upon release of the clamp from its closed position. The battery may be rechargeable and a combination battery charger-storage rack may be provided for holding the curler and recharging the battery without need to remove the battery from the battery compartment.

11 Claims, 7 Drawing Figures

ELECTRIC HAIR CURLER WITH SELF-CONTAINED BATTERY POWER SUPPLY

BACKGROUND OF THE INVENTION

1. Field of the Invention

The present invention relates generally to hair curlers of the type generally used by women for curling normally straight hair and more particularly is directed to a heated hair curler with self-contained power source.

2. State of the Prior Art

Hair curlers have been used for a long time and many different types of heated hair curlers are known as exemplified by the following patents:

| Patent No. | Patentee | Issued |
|---|---|---|
| 3,431,917 | Harris | March 11, 1969 |
| 3,600,552 | Tolmie | August 17, 1971 |
| 3,610,878 | Thomas, et al | October 5, 1971 |
| 3,946,196 | Waters, et al | March 23, 1976 |
| 3,632,971 | Flanagan | January 4, 1972 |
| 3,858,588 | Walter, et al | January 7, 1975 |

The heated hair curlers of the prior art are uniformly characterized by the need for a separate external power supply which normally consists of the household AC current.

A need, therefore, exists for heated curlers which can be used at locations where such power is not readily available. Applicant is not aware of any existing curlers which satisfy this need.

SUMMARY OF THE INVENTION

A self-powered, heated hair curler unit is disclosed which may be conveniently carried in a handbag or the like for use at locations remote from a source of electrical power or where convenient access to an outlet of electrical power is not available.

The novel hair curler of this invention includes a battery power supply which powers a heating element provided in the hair roller body. The curler is provided with a pivotable hair clamping arm and a power switching arrangement which is associated with the clamp such that the heater circuit is interrupted when the clamp is in its open position, this being the normal condition for the clamp when the curler is not in use.

In a presently preferred embodiment the heating element is activated by manually inserting an electrical plug into a mating jack to establish an electrical connection between the battery and a heating coil wound about the curler body.

Prior hair curlers incorporate a spring for urging the clamping arm to a normally closed position, such an arrangement is exemplified by the teaching of U.S. Pat. No. 3,291,142 issued Dec. 13, 1966 to this applicant as co-inventor with Jack Green. In the present invention the plug and jack arrangement is also advantageously utilized to positively secure the pivotable clamping arm in its closed position for holding the hair wound about the curler body. Secure clamping of the curler is of particular importance in the invented device because of the added weight of the self-contained battery. While desirably the heating coil is constructed so as to be adequately powered by a relatively small and lightweight battery, nonetheless, the overall weight of the invented hair curler may be somewhat greater than existing externally powered hair curlers and thus requires more secure clamping to avoid slipping of the hair curler out of the hair under its own weight. Thus, the plug and jack connection is also used to firmly clamp the hair between the pivoting arm and the roller body, eliminating the need for a stronger spring than has been typically used in the prior art to urge the clamp against the roller. In addition, the clamp arm of the present invention is enlarged so as to define a housing for the battery thus also providing a relatively large clamping arm area which cooperates with the roller body to hold the hair wound about the roller body in close contact with the heated curling surface of the roller.

Unlike a simple push button switch, the plug and jack arrangement of the preferred embodiment of this invention is substantially fool proof in that it requires deliberate and intelligent effort to close the heater circuit, and thus prevents accidental activation of the heater while it is carried in a purse. In an alternate ambodiment of the invention, however, it is contemplated that the plug and jack arrangement may be replaced with an electrical switch connected to the heater element and the battery supply and is mounted such that it is actuated when the clamp arm is pivoted to the closed position. In such an alternate embodiment it is desirable to provide a spring for holding the clamp in its closed position. In the preferred embodiment this holding function is performed by the plug which is mated to its jack. However, if the plug is removed, there is nothing to hold the clamp against the curler body. The spring loading of the clamp may be as shown in U.S. Pat. No. 3,291,142.

These and other characteristics of the present invention are better understood by reviewing the following figures, which are submitted for the purposes of illustration only and not limitation, wherein like elements are referenced by like numerals, in light of the detailed description of the preferred embodiment.

DETAILED DESCRIPTION OF THE PREFERRED EMBODIMENT OF THE INVENTION

Figure 1:
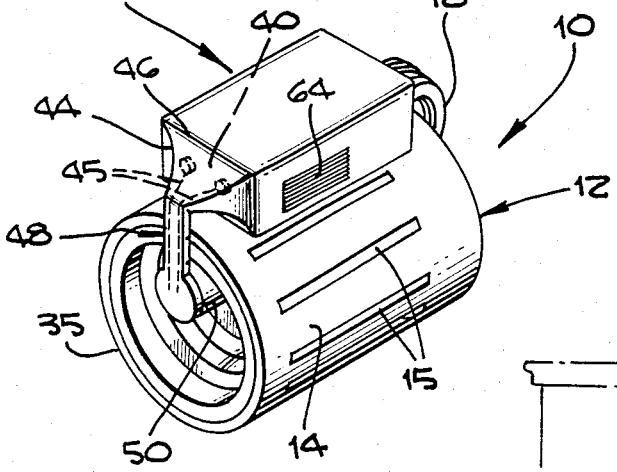
FIG. 1 is a perspective view of the heated hair curler of this invention.

With reference to FIG. 1, the self-powered heated hair curler 10 is seem to comprise a roller body 12 which is of substantially cylindrical shape and defines an external hair curling surface 14. The curling surface may have axial slots 15 in order to facilitate the radiation of heat from a heater coil wound coaxially with the roller 12 underneath the curling surface 14. A hair clamping arm 16 is mounted by means of a hinge 18 for pivotal movement between a closed position shown in FIG. 1 and in solid lines in FIG. 2 and an open position shown in phantom line in FIG. 2.

The roller body 12 comprises an outer cylinder 20 within which are fitted a front end insert 22 and a rear end insert 24. The rear end insert includes a cylindrical flange 26 which extends coaxially within the curler cylinder and seats at its free inner end into a circular groove 32 defined on the inner face of the front insert 22. The cylindrical flange 26 defines a annular heater space 28 with the inner surface of the roller cylinder 20. Within the heater space 28 is wound a heating element 30 which may be a coil of resistance wire such as Nichrome or the like. The front insert is apertured at 25 for mounting an electrical jack 34 which is connected by means of a pair of conductors 36 to the two ends of the heating element 30. The rear insert 24 is preferably also provided with an opening 39 to allow circulation of air into the interior of the roller assembly and thus avoid excessive heat build up within the roller.

Figure 2:
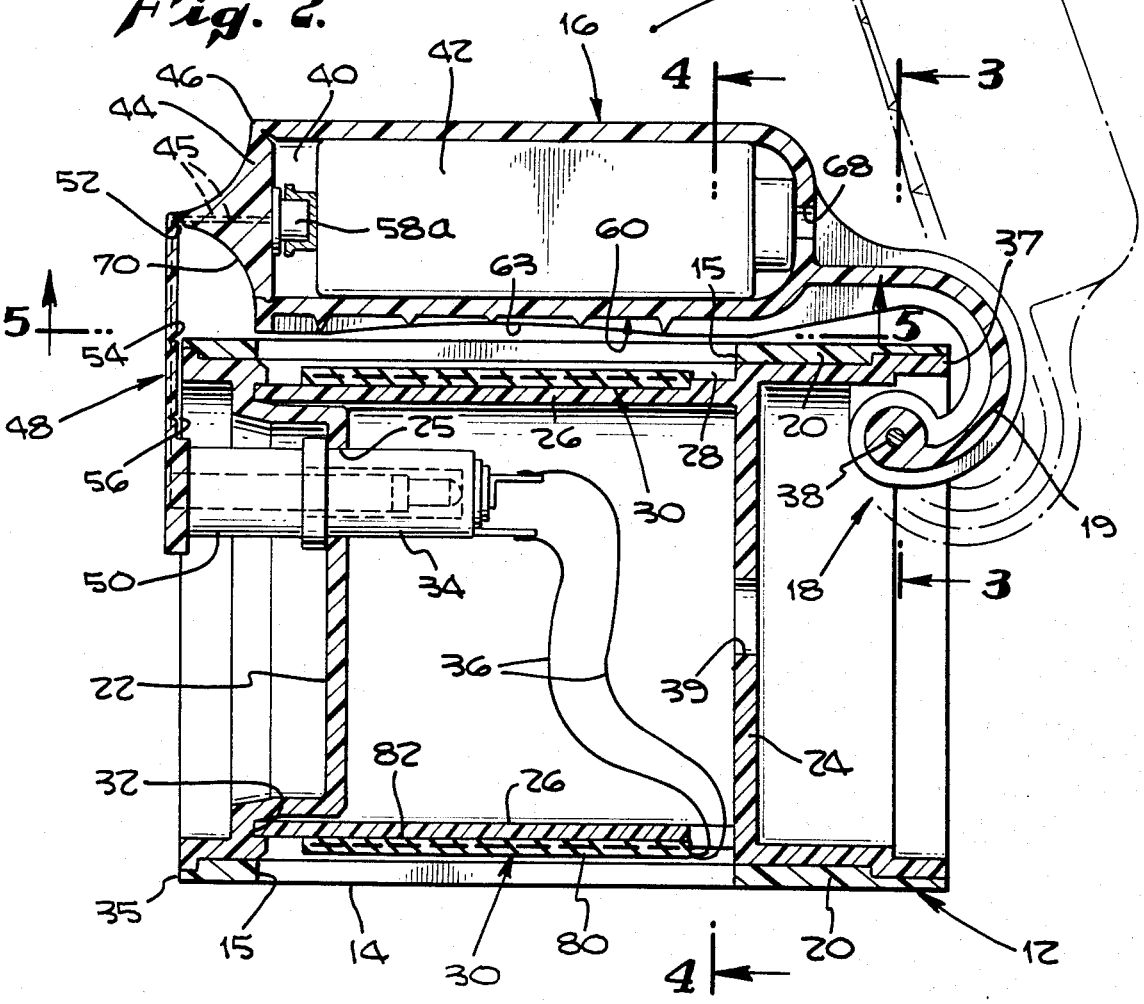
FIG. 2 is an elevational cross section of the curler of FIG. 1 taken along the roller axis and also showing in phantom line the clamping arm in its open position.
Figure 3:
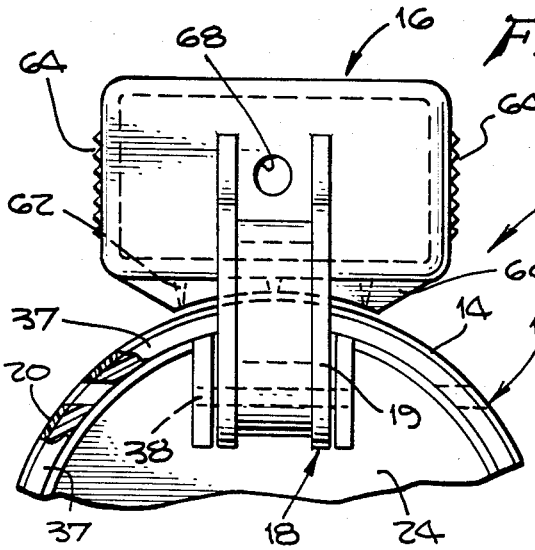
FIG. 3 is a section taken along line 3—3 in FIG. 2.

The clamping arm 16 is pivoted to the rear insert 24 by a hinge 18 at point 38 as best seen in FIG. 3. A hinge arm 19 curves in a 180 degree arc from the pivot point 38 over the rear rim 37 of the roller cylinder and connects to the rear end of the clamping arm 16. Thus, the clamp may be pivoted from the closed position shown in solid lines in FIG. 2 where the clamp is substantially parallel to the roller axis, to an open position illustrated in phantom line in the same figure where the clamp approaches a perpendicular relationship with the roller axis.

Figure 4:
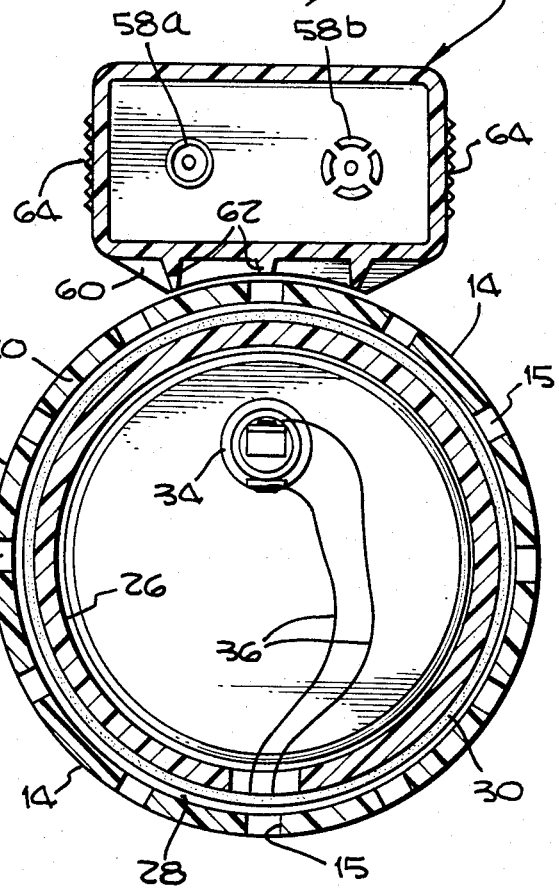
FIG. 4 is a section taken along line 4—4 in FIG. 2 with the battery removed.
Figure 5:
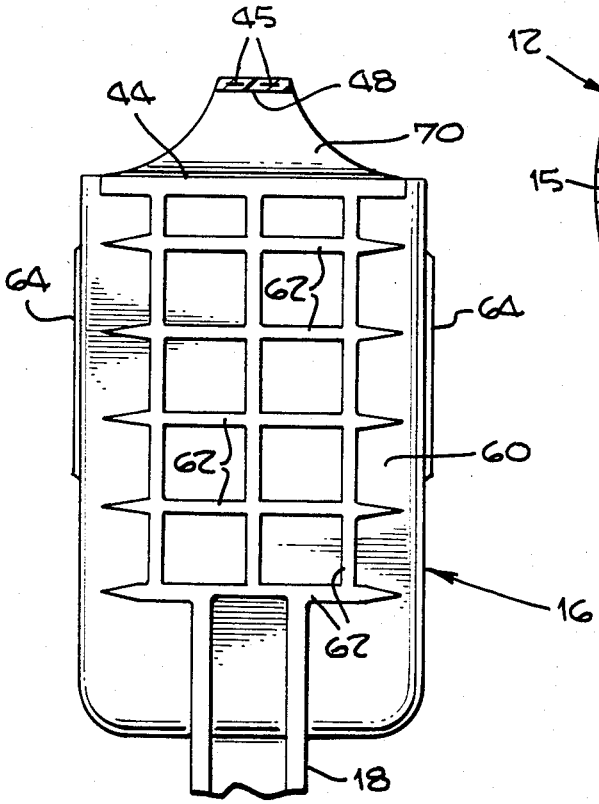
FIG. 5 is a section taken along 5—5 in FIG. 2.

The clamping arm 16 is desirably of rectangular cross section as best appreciated in FIGS. 3 and 4 and defines an interior battery compartment 40 which is dimensioned and shaped to house a battery 42, shown only in FIG. 2. Preferably a single battery also of rectangular cross section is used and has two terminals provided at its forward end extending towards the front of the clamping arm 16. It will be understood, however, that one or more cylindrical batteries may also be housed in the clamping arm 16 with proper modifications to the interior dimensions and shape of the compartment 40 and provision for different battery terminal arrangements.

The free front end of clamp 16 is provided with a hinged access door 44 which may be formed integrally with the clamping arm and hinged at a corner 46. A radial arm 48 extends from the access door 44 towards the interior of the roller cylinder and supports at its free radially inner end an electrical plug 50. The length of the arm 48 is such as to predispose the plug 50 in aligned relationship with the jack 34. Thus, when the clamp 16 is swung to its closed position, the plug 50 may be readily mated to the jack 34 by pushing inwardly on the lower end of the arm 48. The plug 50 is received by the jack 34 along an axial direction, such that the plug cannot be withdrawn by radial force exerted by the clamp 16 due to compressive force exerted on hair wound about the roller body.

In a preferred embodiment, the plug supporting arm 48, the access door 44, the clamping arm 16 and hinge 18 are all formed integrally of a relatively pliable material such as polypropylene which is formed with hinge lines of reduced thickness 46, 52, 54 and 56. Thus, the radial plug supporting arm 48 may be bent at each of the points 52, 54 and 56 so as to facilitate extraction of the pug 50 from the jack 34 without unduly straining the arm 48. The access door 44 is provided with a pair of terminals 58*a* and 58*b* (best seen in FIG. 4) which are positioned for mating engagement with the terminals of a battery 42 in the compartment 40 when the access door 44 is pivoted to the closed position shown in FIG. 2. Conductors 45 are provided through the access door 44 and along the radial arm 48 for connecting the battery housing terminals 58*a* and 58*b* to corresponding terminals of the plug 50. The conductors 45 may be etched copper conductors deposited on the inner surface of the radial arm 48 or may be wires molded into the thermolplastic material of the access door 44 and radial arm 48. Various means for connecting the terminals 58*a* and 58*b* to the plug 50 will become apparent to those skilled in the art. The conductors should, however, be sufficiently flexible so as to tolerate flexing of the radial arm 48 during insertion and withdrawal of the plug 50 without undue strain or danger of breakage.

The clamp arm 16 as was previously described is preferably of rectangular cross section and defines a clamping surface 60 opposite the curling surface 14 of the roller body 12. The clamping surface 60 is desirably shaped to conform to the curvature of the curling surface. In the illustrated embodiment this shaping is achieved by providing a grid of raised ribs 62 molded on the surface 60. The ribs are concavely curved both along the axial and radial direction of the roller body. The axial concavity may be best appreciated by reference to FIG. 2 where a concavity 64 is defined by the axially extending ribs for containing a lock of hair wound about the roller body. The radial curvature of the ribs may be seen in FIGS. 3 and 4 where the axially transverse ribs conform to the curvature of the cylindrical curling surface 14.

The clamp 16 may be further provided with ridges 64 along its lateral surfaces to prevent fingers from slipping along the surfaces and thus ensure a more secure grasp of the clamp for pivotal movement thereof. A vent opening 68 may be provided in the rear face of the clamp to ventilate the battery compartment 40.

The plug supporting radial arm 48 and hinged access door 44 are articulated at the indicated points 52, 54, 56 and 46 by transverse grooves which define lines of reduced thickness to allow the pliable material to readily bend at those points. The curler body and the clamp structure may be formed of a suitable material such as polypropylene which satisfies the requirements of flexibility for the various articulated and hinged portions, good electrical insulating properties, and adequate thermal tolerance to withstand the heat generated by the heating element 30 without softening or warping. The length of the radial arm 48 is such as to hold the clamp 16 against the curling surface 20 of the curler when the plug 50 is inserted into the jack 34. A forwardly tapering portion 70 may extend from the axis door 44 and connected to the upper end of the radial arm 48 and includes a resiliently pliable thin forward end which is flexible so as to absorb some of the strain imposed on the radial arm 48 when hair is clamped between the clamp 16 and the roller body 12. Some additional degree of flexibility will be built into the clamp structure since the curved hinge 18 will bend and yield somewhat against the pressure of hair clamped between the clamp 16 and roller body 12.

Figure 6:
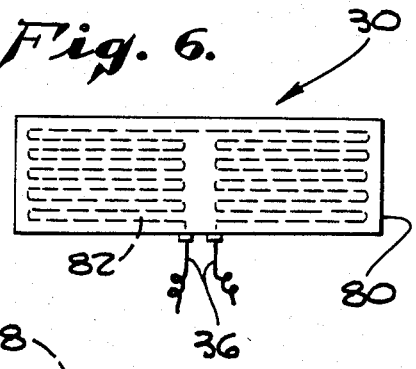
FIG. 6 illustrates a presently preferred type of heating element for the novel hair curler.
Figure 6:
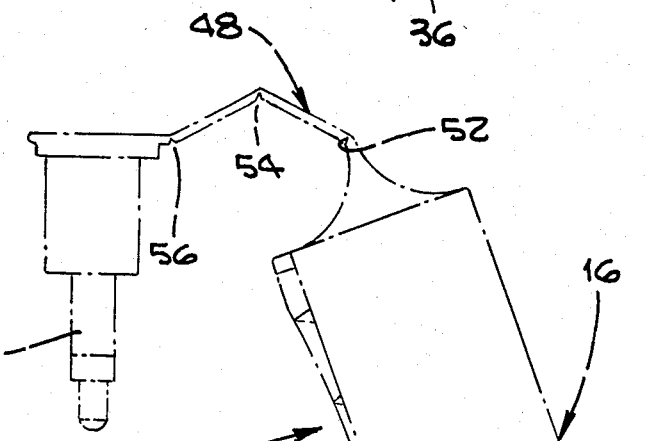

FIG. 6 illustrates a presently preferred form of the heating element 30 which includes a sheet 80 of a plyable, electrically insulating material on which is deposited an electrically resistive element 82. Resistance element 82 may consist of a continuous length of wire such as Nichrome or equivalent resistance wire laid out and secured to the supporting and insulating sheet 80 in a pattern, for example, as illustrated in FIG. 6, so as to distribute the heated generated by an electrical current passing through the element 82 in an approximately even manner over the surface of the sheet 80. The element 82 is terminated by connecting its two ends to the terminals of the jack 34 by means of conductors 36 as illustrated in FIG. 2. The heating element 30 is mounted to the curler assembly by wrapping it about the outer surface of the cylindrical flange 26. The heating element is thus disposed beneath, but in close proximity to the outer curling surface 14 of the roller body. The heat generated by electrical current passing through the heating element is both radiated outwardly so as to heat the curler body and is also carried by convection through the slots 15 extending in an actual direction across the curling surface 14.

The heating element 30 may be powered by a battery 42 which desirably is a low voltage, e.g. 4 volt battery capable of high current output during a relatively short time interval, such as 20 minutes. The battery is preferably of the rechargeable type such as a nickel cadmium battery, such that it may be recharged in a suitable battery charger after a 20 minute heating cycle.

Figure 7:
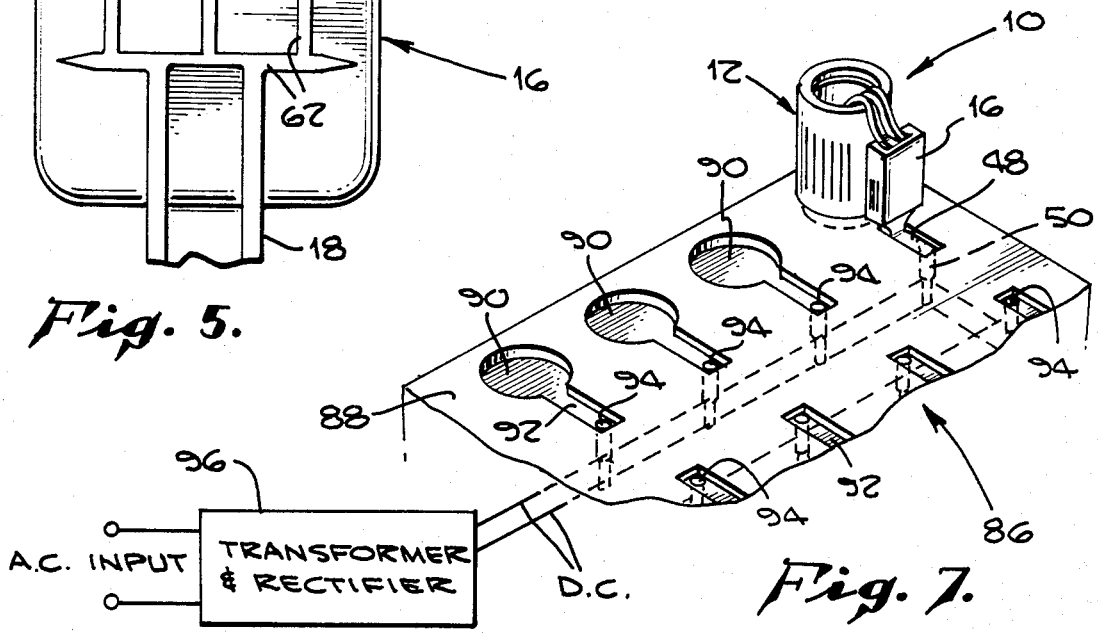
FIG. 7 shows a battery charger/storage rack for a number of self-powered heated hair curlers.

FIG. 7 illustrates one possible design for a combination battery charger/storage rack 86 for the heated hair curlers configured as in FIGS. 1 and 2. The battery charger/storage rack 86 has a planar upper surface 88 in which are defined one or more circular depressions 90 sized to receive one end of the cylindrical curler body 12 of the heated hair curler 10. A rectangular depression 92 extends radially from each of these circular depressions. At the radially outer end of the depression 92 is provided an electrical jack 94 which is connected by means of electrical conductors running underneath the surface 88 to a power supply 96 also mounted underneath the surface 88 of the battery charger/storage rack. The power supply may include a transformer, rectifier, and current regulator circuit for transforming household A.C. current to a D.C. voltage and current suitable for recharging the batteries for the two in each of the hair curlers 10 connected to the power supply 96 through the jacks 94 in each of the depressions 90. For recharging the battery, the plug 50 is withdrawn from the curler jack 34, and the plug supporting arm 48 is bent radially outwardly at hinge 52. The front end 35 of the curler body 12 is then inserted into a vacant depression 90 on the charger 86 with the plug supporting arm 48 in alignment with the radial depression 92. The plug 50 will then be aligned for insertion into the charging jack 94. The plug 50 is simply pushed into the jack 94 to connect the battery 42 with the power supply circuit 96.

In this manner a number of self-powered heated hair curlers 10 may be easily and conveniently recharged without need to remove the battery 42 from its housing in the clamping arm of each hair curler.

In an alternate embodiment of the invention, the plug 50 and jack 34 may be replaced by a switch such as a push button single pole, single throw switch mounted, for example, to the rear end of the roller body 12 under the clamping arm 16, so that when the clamp 16 is swung to its closed position, the switch is depressed and the heater circuit is closed. In such an alternate embodiment, the wires 45 are to be connected to such a switch and from the switch to the wires 36 of the heating element 30. The wires 45 may be extended to run rearwardly within the clamping arm 16, exiting in the area of the hinge mounting 38 and loosely extending from there to the switch mounted on the curler body 12. Various arrangements for interconnecting the battery wires 45 to the heating element wires 36 through a switch are possible, and any suitable arrangement serving to establish the electrical connection while also allowing substantially unrestricted pivotal movement of the clamping arm 16 may be adopted. Various possible alternate switch arrangements will become apparent to those skilled in the art in light of the present disclosure, without departing from the spirit and scope of the present invention.

If the plug and jack are eliminated in favor of a switch as described in the preceding paragraph, it is desirable to provide some means of holding the clamping arm in its closed position. This function may be performed by a spring connected between the clamping arm and the rear end insert 24 in an over the center arrangement relative to the pivot point 38. In the alternative, a helical torsion spring may be mounted about the pivot axis 19 of the clamping arm, one end of the spring being affixed to pivoting clamp 16 and the other end attached to the curler body 12 so that the clamp is continuously urged to its closed position. Yet other ways of securing the clamp 16 in its closed position following activation of the heater element will be apparent to those skilled in the art.

It must be understood that many alterations and modifications may be made by those having ordinary skill in the art to the structure of the present invention without departing from the spirit and scope of the invention. Therefore, the presently illustrated embodiment has been shown only by way of example and for the purposes of clarity and should not be taken to limit the scope of the following claims.

I claim:

1. A self powered heated hair curling roller comprising, in combination:

a roller body;

a hair retaining clamp pivotably attached at one end to said roller body and pivotable between an open position in which the free end of the clamp is spaced from said roller body to allow hair to be wound on said roller body and a closed position wherein said free end is nearest said roller body to clamp the hair wound on the roller body;

electrical heater means associated with said roller body for heating said roller body;

a battery compartment defined within one of said roller body or said clamp;

cooperative separable connector means on said clamp and roller body for operatively electrically interconnecting a battery in said battery compartment and said heater means; and said connector means also operating as a mechanical fastener for securing said free end of said clamp to said roller body in said closed position such that the electrical connection is interrupted upon release of said clamp.

2. A self powered heated air curling roller comprising in combination:

a roller body defining an exterior curling surface;

electrical heater means within said roller body for heating said curler surface;

a hair clamp having an end pivotably mounted to said roller body and a free end movable towards and away from said roller body between an open position in which the free end of the clamp is spaced from said roller body to allow hair to be wound on said roller body and a closed position wherein said free end is nearest said roller body to clamp the hair wound on the roller body;

a battery compartment defined within said clamp;

cooperative separable electrical connector means on said roller body and said clamp for electrically connecting a battery in said battery compartment to said heater means, said electrical connector means also operating as a mechanical fastener for securing said free end of said clamp to said roller body in said closed position to hold said clamp against movement away from said roller body.

3. The device of claim 2 wherein said electrical heater means is an electrically resistive element disposed beneath said exterior curling surface.

4. The device of claim 2 wherein said roller body is substantially cylindrical and said electrical heater means is a resistance wire positioned coaxially with said roller body beneath said exterior curling surface.

5. The device of claim 2 wherein said electrical connector means comprise a first connector element mounted to said clamp and connected to said battery and a second connector element secured to said roller body and connected to said heater means;

said first and second connector elements being detachably mateable when said clamp is in said closed position for powering said heater means and also securing said clamp in said closed position.

6. The device of claim 5 wherein said first and second connector elements are a male plug and a female jack respectively;

said jack being mounted for receiving said plug in an axial direction, so that said plug is not disengaged from said jack by radial force exerted by said clamp on said plug.

7. The device of claim 5 wherein said clamp includes a hinged door at said free end for access into said battery compartment, a radial arm extending from said access door and supporting said first connector element, and electrical conductors supported by said radial arm and adapted to connect the battery to said first connector element.

8. The device of claim 7 further comprising a plurality of terminals electrically connected to said electrical conductors, said terminals being mounted to said hinged door and positioned for connection with a battery in said housing when said hinged door is closed.

9. The device of claim 7 wherein said radial arm is flexible in an axial plane of said curler body for facilitating engagement of said first connector element with said second connector element, but substantially rigid in a plane transverse to the axis of said curler body to thereby maintain said first connector element in substantial alignment with said second connector element for easy mating of said connector elements.

10. The device of claim 2 wherein said clamp is of substantially rectangular cross section and has a clamping surface cooperating with said roller body for clamping hair therebetween.

11. The device of claim 10 said clamping surface further being provided with portions contoured to said curling surface for securely holding hair between said clamp and said roller body.

* * * * *